US007222826B1

(12) United States Patent
Berglund

(10) Patent No.: US 7,222,826 B1
(45) Date of Patent: May 29, 2007

(54) ADAPTIVE ARM SUPPORT

(76) Inventor: Andrew Berglund, 819 W. 2nd St., Northfield, Rice, MN (US) 55057

( * ) Notice: Subject to any disclaimer, the term of this patent is extended or adjusted under 35 U.S.C. 154(b) by 242 days.

(21) Appl. No.: 10/722,035

(22) Filed: Nov. 24, 2003

Related U.S. Application Data

(60) Provisional application No. 60/428,528, filed on Nov. 23, 2002.

(51) Int. Cl.
*B43L 15/00* (2006.01)

(52) U.S. Cl. ..... 248/188.1; 248/118; 248/276.1; 248/282.1; 248/918

(58) Field of Classification Search ..... 248/118, 248/118.1, 118.3, 918, 276.1, 282.1
See application file for complete search history.

(56) References Cited

U.S. PATENT DOCUMENTS

| | | | | |
|---|---|---|---|---|
| 520,711 | A | 5/1894 | Shea | |
| 607,675 | A | 7/1898 | Barr | |
| 794,042 | A | 7/1905 | O'Connor | |
| 1,277,169 | A | 8/1918 | Anderson | |
| 1,516,795 | A * | 11/1924 | Schwarting | 5/646 |
| 1,611,084 | A | 12/1926 | Storey | |
| 1,721,221 | A * | 7/1929 | Jauregui | 297/344.18 |
| 4,237,873 | A | 12/1980 | Terry et al. | |
| 4,259,949 | A | 4/1981 | Axelsson | |
| 4,784,120 | A | 11/1988 | Thomas | |
| 4,913,393 | A | 4/1990 | Wood | |
| 4,996,977 | A | 3/1991 | Tiedeken | |
| 4,997,054 | A * | 3/1991 | Denny et al. | 180/331 |
| 5,004,196 | A | 4/1991 | Gross | |
| 5,040,813 | A | 8/1991 | Cumble | |
| 5,058,840 | A | 10/1991 | Moss et al. | |
| 5,074,501 | A | 12/1991 | Holtta | |
| 5,088,668 | A | 2/1992 | Grimm | |
| 5,092,552 | A * | 3/1992 | Dayton et al. | 248/280.11 |
| 5,104,073 | A | 4/1992 | VanBeek et al. | |
| 5,135,190 | A | 8/1992 | Wilson | |
| 5,147,090 | A | 9/1992 | Mandell et al. | |
| 5,158,256 | A | 10/1992 | Gross | |
| 5,201,485 | A | 4/1993 | Moss et al. | |
| 5,231,998 | A | 8/1993 | Rosen et al. | |
| 5,281,001 | A | 1/1994 | Bergsten et al. | |
| 5,326,154 | A | 7/1994 | Williamson et al. | |
| 5,329,941 | A | 7/1994 | Bodine, Jr. | |
| 5,337,737 | A | 8/1994 | Rubin et al. | |
| 5,386,957 | A | 2/1995 | Miller | |
| 5,398,896 | A | 3/1995 | Terbrack | |
| 5,402,972 | A | 4/1995 | Schmidt | |
| 5,405,109 | A | 4/1995 | Nordnes | |
| 5,465,931 | A | 11/1995 | MacDonald | |

(Continued)

*Primary Examiner*—Amy J. Sterling
(74) *Attorney, Agent, or Firm*—Albert W. Watkins

(57) ABSTRACT

An adaptive arm support provides motion of an armrest within a plane through any direction of translation. A number of vertical rods and bearings permit at least two links to pivot with respect to each other, permitting translation in any direction while staying within the plane. Bushing-tipped set screws are provided which dampen movement, to reduce or eliminate the effects of unintentional tremors. The armrest includes a swivel mounting which is also damped, which permits the longitudinal axis of the armrest to swivel from horizontal orientation to inclined angles which are out of the plane of translation. An elbow pad is provided which also pivots from perpendicular to the armrest longitudinal axis to different angular orientation with respect thereto.

19 Claims, 2 Drawing Sheets

U.S. PATENT DOCUMENTS

| | | | | |
|---|---|---|---|---|
| 5,655,814 | A | | 8/1997 | Gibbs |
| 5,685,719 | A | | 11/1997 | Bressler |
| 5,707,160 | A | | 1/1998 | Bowen |
| 5,713,591 | A | | 2/1998 | Zarkhin et al. |
| 5,718,671 | A | | 2/1998 | Bzoch |
| 5,743,499 | A | | 4/1998 | Wang |
| 5,753,840 | A | | 5/1998 | Saboia De Albuquerque |
| 5,876,362 | A | | 3/1999 | Root |
| 5,881,976 | A | | 3/1999 | Gutowski |
| 5,915,655 | A | | 6/1999 | Gutowski |
| 5,975,469 | A | | 11/1999 | Chen |
| 6,000,916 | A | * | 12/1999 | Martin et al. ..... 417/360 |
| 6,042,064 | A | | 3/2000 | Hong |
| 6,056,162 | A | * | 5/2000 | Leighley ..... 222/156 |
| D438,725 | S | | 3/2001 | Takahashi |
| 6,347,771 | B1 | | 2/2002 | Lauzon et al. |
| 6,454,224 | B1 | | 9/2002 | Nogueira |
| 6,619,747 | B2 | * | 9/2003 | Ko et al. ..... 297/423.12 |
| 6,704,959 | B2 | * | 3/2004 | Schuerch ..... 5/648 |
| 6,786,461 | B1 | * | 9/2004 | Tsai et al. ..... 248/118.3 |
| 2002/0179782 | A1 | | 12/2002 | Smeed |

* cited by examiner

ADAPTIVE ARM SUPPORT

CROSS REFERENCE TO RELATED APPLICATIONS

This application claims priority to co-pending U.S. provisional patent application Ser. No. 60/428,528 filed Nov. 23, 2002 entitled "Adaptive Keyboard Guard" and invented by the present inventor, the contents which are incorporated herein by reference in entirety.

BACKGROUND OF THE INVENTION

1. Field of the Invention

This invention pertains generally to supports, and more specifically to arm supports which permit persons with specific conditions to adapt to a common-place environment. The arm supports thereby improve the condition of the persons, and, as a desirable adjunct, improves the conditions of others as well.

2. Description of the Related Art

For the purposes of the present disclosure, impairment will define a deviation from normal, such as not being able to make a muscle move or not being able to control an unwanted movement. Disability will be defined herein as a restriction in the ability to perform a normal activity of daily living which someone of comparable age is able to perform. Handicap will be defined herein as a person who, because of a disability, is unable to achieve a normal role in society commensurate with age and socio-cultural factors. All disabled people are impaired, and all handicapped people are disabled, but a person can be impaired and not necessarily be disabled, and a person can be disabled without being handicapped. With greater degree of impairment, which may lead to associated handicap or disability, comes a separation sometimes associated with unfavorable stereotyping and extra care which is required. This can include relegation to less favorable living or environmental conditions. In addition, there may be undesirable losses in confidence and self-esteem. There is, of course, much more to an individual than the disability, which has led to the promulgation of many laws, including, where appropriate, the inclusion of children with handicaps, disabilities or impairments into regular classrooms. There has, in general, been an increasing awareness and sensitivity, both among the general public and in literature, including addressing issues of education, employment, and public access for disabled individuals. Assistive technology, which may permit an individual to overcome an impairment to either reduce the effects from disabilities to handicaps or to simple impairments continues to be adopted as quickly as it is practically developed. One such example is crutches and leg braces, which permit a person to walk without the confines of a wheelchair. While the individual may still be recognized as having an impairment, the severity of and consequences from the impairment are reduced.

One area of particular application to the present invention is that of tremors, uncontrollable spasms, ataxia and the like. There are many different nervous system and muscular ailments that are known to adversely affect the motor operations of an individual's limbs. Exemplary of these, but not solely limited thereto, are: Angelman Syndrome; Cerebral Palsy; Essential Tremor; Hepatolenticular Degeneration (Wilson's Disease); Miller Fisher Syndrome; Multiple System Atrophy; Parkinson's Disease; Progressive Supranuclear Palsy; Torsion Dystonia; and Tourette Syndrome. Further events that can adversely affect motor operation and induce tremors include exposure to hazardous chemical elements and compounds, including such diverse exposures as mercury or heavy metal poisoning and insecticide or pesticide exposure, and traumas. Many of the ailments are accompanied by either permanent or temporary loss of particular motor skills, and may further be aggravated by muscle tremors or twitches which tend to mask the primary motor functions being expressed by the individual.

There are an estimated 34 million people in the United States with some type of tremor. While many of these are associated with a specific disease, trauma or other initiator, approximately ten million of these cases are only characterized by the tremor itself. While some types of tremors are manageable with medications or surgery, others are not. These tremors can be quite challenging, frustrating and even humiliating for the individual and those either emotionally or professionally close to the individual. Many different commonplace task may be prevented or adversely impacted by the particular symptoms presented by the individual.

Disabilities from tremors encompass, though are not solely limited to, impaired fine motor tasks such holding or manipulating small objects, such as small tools or utensils, writing, drinking from a cup, eating, applying makeup, shaving, or dressing. Similar to the crutches example described herein above, assistive technologies which could allow an individual to diminish or eliminate disabilities or handicaps are very much desired. These assistive technologies are herein referred to as adaptive technologies, since they permit the person to adapt to effectively fulfill the requirements of a task.

A number of artisans have provided various supports, including arm and forearm support. Many of these only provide basic support against gravitational forces, and as a result, these are of no value in the adaption of an individual with tremors or the like. More frequently, these type of supports have found application in such environments as offices and the like, where unnecessary fatigue and such ailments as carpal-tunnel syndrome may be alleviated. Exemplary of the large body of literature are U.S. Pat. No. 794,042 by O'Conner; U.S. Pat. No. 1,277,169 by Anderson; U.S. Pat. No. 1,611,084 by Storey; U.S. Pat. No. 4,237,873 to Terry et al; U.S. Pat. No. 4,259,949 by Axelsson; U.S. Pat. No. 4,913,393 by Wood; U.S. Pat. No. 4,996,977 by Tiedeken; U.S. Pat. Nos. 5,004,196 and 5,158,256 by Gross; U.S. Pat. Nos. 5,058,840 and 5,201,485 by Moss et al; U.S. Pat. No. 5,074,501 by Holtta; U.S. Pat. No. 5,135,190 by Wilson; U.S. Pat. No. 5,147,090 by Mandell et al; U.S. Pat. No. 5,281,001 by Bergsten et al; U.S. Pat. No. 5,326,154 by Williamson et al; U.S. Pat. No. 5,329,941 by Bodine; U.S. Pat. No. 5,337,737 to Rubin et al; U.S. Pat. No. 5,386,957 by Miller; U.S. Pat. No. 5,398,896 by Terbrack; U.S. Pat. No. 5,402,972 by Schmidt; U.S. Pat. No. 5,405,109 by Nordnes; U.S. Pat. No. 5,655,814 by Gibbs; U.S. Pat. No. 5,685,719 by Bressler; U.S. Pat. No. 5,707,160 by Bowen; U.S. Pat. No. 5,713,591 by Zarkhin et al; U.S. Pat. No. 5,718,671 by Bzoch; U.S. Pat. No. 5,743,499 by Wang; U.S. Pat. No. 5,753,840 by Saboia De Albuquerque; U.S. Pat. No. 5,876,362 by Root; U.S. Pat. No. 5,881,976 and U.S. Pat. No. 5,915,655 by Gutowski; U.S. Pat. No. 5,975,469 by Chen; U.S. Pat. No. 6,042,064 by Hong; U.S. Pat. No. 6,347,771 by Lauzon et al; U.S. Pat. No. 6,454,224 by Nogueira; 2002/0179782 by Smeed; and D438,725 by Takahashi, each which are incorporated herein by reference for their teachings of mechanics and structures.

Adaptive technologies have been developed as well, though in the prior art there have been limitations incorporated into each of these that have tended to limit applications. One type of adaptive technology involves the use of frameworks of relatively significant size and structure. These structures are designed to offer optimum interaction with the musculo-skeletal system of the user, but, owing to their size and complexity, also incur the greatest expenses and public resistance to use. Said another way, the functioning may offer mechanical advantage, but the size and expense are economically as well as aesthetically undesirable. Exemplary of these frameworks are U.S. Pat. No. 4,237,873 to Terry et al; U.S. Pat. No. 5,231,998 by Rosen et al; and U.S. Pat. No. 5,337,737 to Rubin et al, the teachings of each which are also incorporated herein by reference.

While not as adaptive for all activities, several additional artisans have offered improved adaptive technologies. Among these are U.S. Pat. No. 4,996,977 by Tiedeken; and U.S. Pat. No. 4,784,120 by Thomas, each which illustrate smaller forearm supports. The teachings of each of these patents are also incorporated herein by reference. Unfortunately, in the Tiedeken patent rails are used which require movement along specific axes. While the system provides substantial dampening of off-axis motion, the mechanics of the system are such to inhibit most movement in a person with typical tremors. Said another way, a person with tremors is generally unable to maintain motion along a single axis. The Tiedeken system would, with each tremor, tend to freeze motion, thereby inhibiting not only tremor movement but also desired movement. The Thomas arm constraint offers an improved feeding apparatus, but is not well adapted to the motions that many persons with tremors would more desirably execute. Further, the Thomas system is relatively specifically limited to feeding, and is not readily adapted to other activities.

SUMMARY OF THE INVENTION

In a first manifestation, the invention is an adaptive support arm for reducing the severity of tremors from disabilities and handicaps to impairments. The adaptive support arm includes a base support for attachment to a wheelchair, table through a table clamp, or other suitable stand. A first support member is pivotal about a first axis passing through the first support member and is also repositionable with respect to the base support along the first axis. A means is provided for variably setting a resistance to first axis pivotal motion. A second support member is pivotal about a second axis displaced from the first axis and passing through both of the first and second support members. A means is provided for variably setting a resistance to second axis pivotal motion. A longitudinally extensive armrest is pivotal about a third axis that is displaced from the second axis and passes through second and third support members. A means is also provided for variably setting resistance to third axis pivotal motion. A pivotal member between armrest and second support member is pivotal about a fourth axis angularly offset from the third axis. A means is provided for variably setting a resistance to the fourth axis pivotal motion. An elbow pad is extendible from the armrest and is pivotal about a fifth axis angularly offset from the armrest longitudinal axis.

In a second manifestation, the invention is an adaptive three-axis arm support. An anchor member affixes to a support such as a wheelchair, table or other suitable structural support. At least one arm restraint is provided, having a longitudinal axis and providing support for a user's arm against the pull of gravity and restraint of said user's arm. A means is provided for suspending and translating the arm restraint in any direction relative to the anchor member, throughout and constrained within two axes which define a planar region of arm restraint positioning. A means is provided to effectively dampen muscle tremors during suspending and translating. At least one means provides height adjustment of the arm restraint to offset the planar region relative to anchor member. At least one means pivots the arm restraint longitudinal axis into and out of the planar region.

In a third manifestation, the invention is an adaptive feeding aid which permits persons afflicted with tremor impairments to feed themselves without feeding disabilities or handicaps. The adaptive feeding aid includes a base support and a longitudinally extensive armrest. An armrest support suspends and translates the armrest relative to base support through and constrained within two axes which define a planar armrest translation region. A means for variably setting a resistance to translating is provided to adjust resistance to different needs of individual users. An adjustable coupler between base support and armrest support is adjusted to reposition the planar armrest translation region relative to base support. The armrest support is repositionable with respect to base support along a first axis normal to the planar armrest translation region and is held with respect thereto when supporting an arm. A pivotal member between armrest and armrest support is pivotal about an axis generally parallel to the planar armrest translation region, and has a means for variably setting a resistance to pivotal motion to adjust resistance to different needs of individual users.

OBJECTS OF THE INVENTION

Exemplary embodiments of the present invention solve inadequacies of the prior art by providing an adaptive arm support which offers three degrees of freedom, but which is frictionally damped through each rotational axis.

A first object of the invention is to provide an adaptive arm support which reduces handicaps and disabilities to impairments. A second object of the invention is to provide such adaptive support arm which has multi-purpose usage, and which is not limited to any one disease, impairment, or task. Another object of the present invention is to provide such support arm in a design and appearance which is both aesthetically attractive and which is reasonably priced, consequently keeping the complexity to a minimum. A further object of the invention is to incorporate reliable components to satisfy durability and reliability most desired for these applications. Yet another object of the present invention is to achieve the foregoing objectives with an apparatus which is comfortable and not intimidating for the individual using the apparatus. An even further object of the invention is to provide an adaptive arm support which is constrained to travel within a plane, and which pivots to longitudinal extend at angles parallel or offset from said plane.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figures 1, 2, 4:
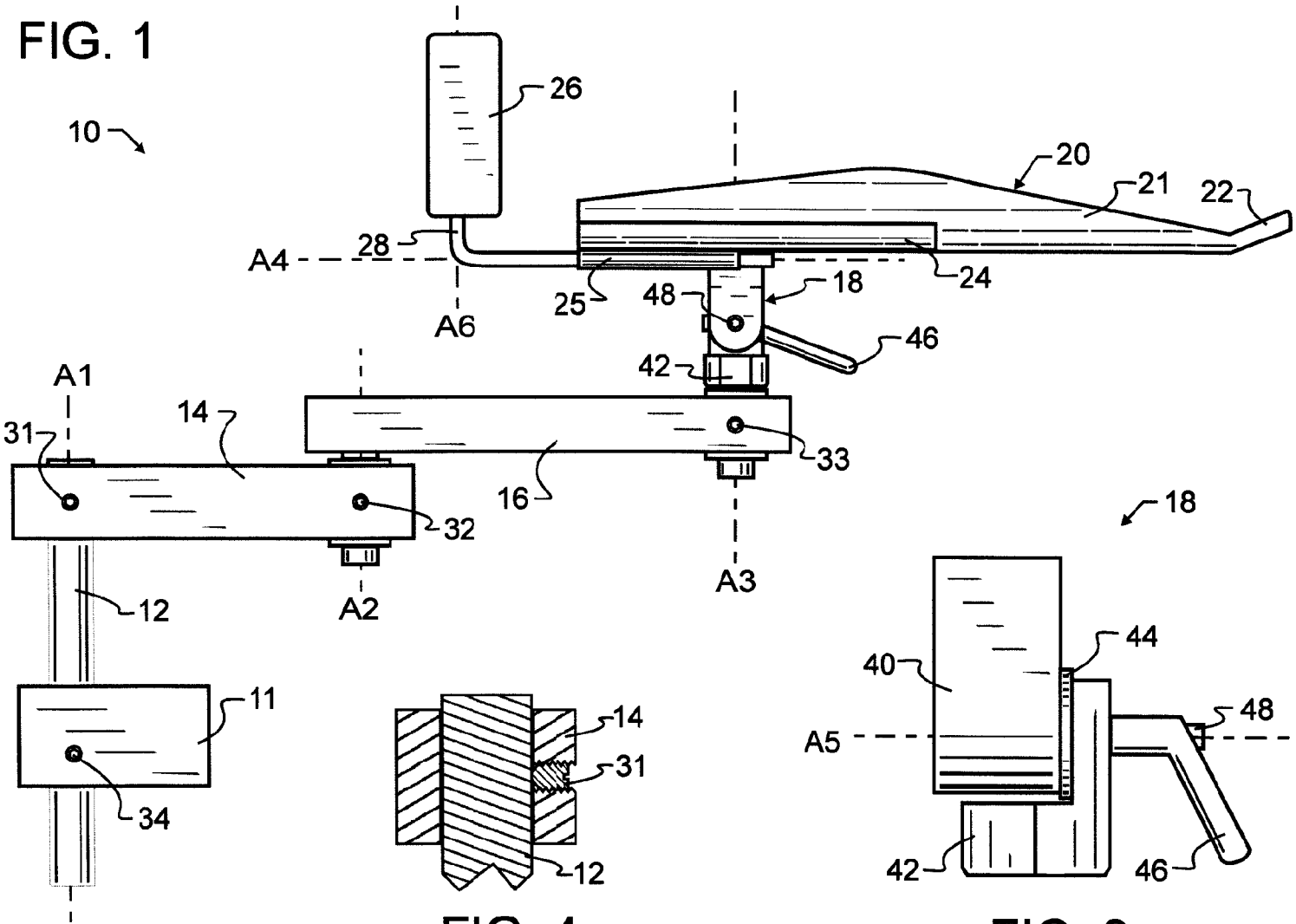
FIG. 1 illustrates a preferred embodiment adaptive support arm designed in accord with the teachings of the present invention from a side plan view showing the arm in a fully extended and horizontal position.
FIG. 2 illustrates a preferred armrest supporting swivel joint which may be used in the preferred embodiment adaptive support arm of FIG. 1, from end plan view.
FIG. 4 illustrates a preferred embodiment construction of an exemplary pivotal joint between rod 12 and support member 14 including a brass-tipped set screw therein to control resistance to motion.

Manifested in the preferred embodiment, the present invention provides an adaptive arm support 10 illustrated by side plan view in FIG. 1. An anchor 11 for attaching to a support, such as a wheelchair, table, or the like is provided. This anchor 11 will be understood to include any necessary geometry to accommodate the chosen support component or surface of attachment, but will in the preferred embodiment include a hole extending there through, through which a rod or pipe such as rod 12 may pass along axis A1. Rod 12 will be retained in anchor 11 through a set screw 34, which in the preferred embodiment will rigidly lock rod 12 to anchor 11. Height adjustment may be made by loosening set screw 34 and sliding rod 12 with respect to anchor 11, and then re-tightening set screw 34. Perpendicular to rod 12 is a support member 14, preferably journalled to rod 12 through a bearing, bushing or the like. Within support member 14 is a set screw 31 of special construction and for special purpose. This set screw 31, along with set screws 32 and 33, has a force responsive bushing formed on the end thereof. In the preferred embodiment, this force-responsive bushing is fabricated as a brass tip which engages with rod 12. Rod 12, in the preferred embodiment, is steel. Consequently, as the force created by tightening these set screws 31–33 is increased, the brass tip provides increased resistance to motion. Since the set screws may be adjusted, the amount of resistance is variable to the needs of an individual. While brass was most preferred, other tip materials, and even other techniques such as dampers, hydraulic devices, magnetic and electromagnetic controls and other devices of like function for providing resistance are contemplated herein, the types of which are too numerous to specifically mention. The most preferred brass tip adjacent steel offers low cost and simplicity, while still providing excellent performance.

Support member 14 is in turn connected to support member 16 through a similar axial joint aligned along axis A2. At an end of support member 16 distal to axis A2 is another similar joint along axis A3 including set screw 33. Attached to this pivotal joint is another, perpendicular axis A5 of movement which, in the preferred embodiment, is controlled by a thumb screw or arm 46 acting to turn bolt 48 and thereby tighten collar 42 and block 40 about brass washer 44. An additional washer similar to washer 44 may also be provided between collar 42 and handle 46, where desired. This hand tightening may be used as an alternative to set screws 31–33, but is reserved in the preferred embodiment at a location that will not likely be disturbed, and for which ready and frequent adjustment may be desired.

Figure 3:
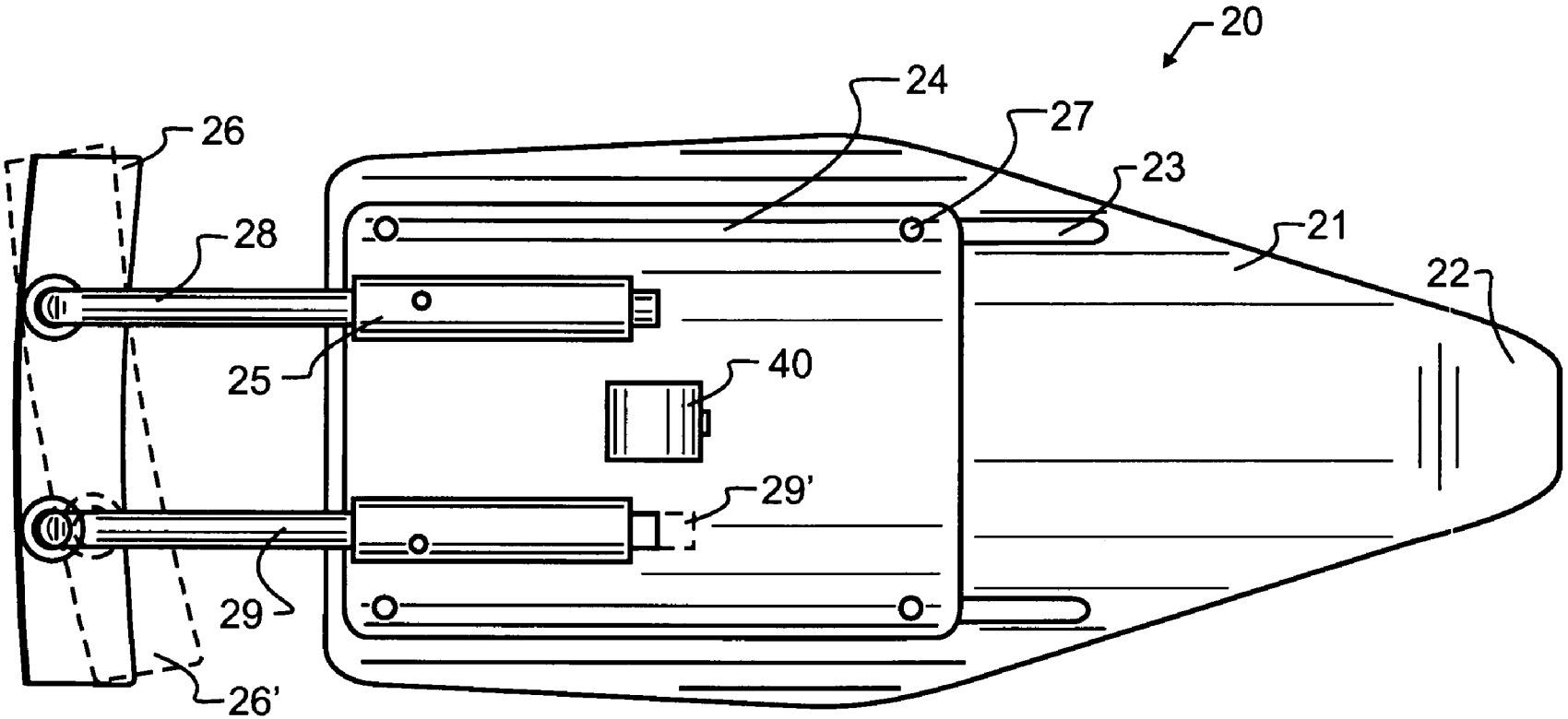
FIG. 3 illustrates a preferred armrest which may be used in the preferred embodiment adaptive support arm of FIG. 1, from bottom plan view.

Resting on block 40 is an armrest 20 which includes a forearm support 21 and a palm rest 22. As is known, various means may be provided to further retain a person's arm therein, including hook and loop fasteners, various straps, special hand-engaging gloves, weights, or other means of attachment or restraint. Armrest 20 defines a longitudinal axis A4, along which elbow pad 26 is designed to travel. Tubes 25 are provided in a armrest plate 24 which permit L-shaped bars 28, 29 to slide. As visible in FIG. 3, these L-shaped bars do not need to slide evenly. As shown therein, bar 28 remains stationary, while bar 29 is moved to the position designated by dashed line 29'. This in turn will cause elbow pad 26 to pivot, so that the outer vertical edges follow the movement of a person's upper arm and do not pinch, poke or constrict such upper arm. As is also visible in FIG. 3, plate 24 is preferably attached to forearm support 21 using fasteners 27 that may, for instance, slide in channels 23 to further adjust the balance and position of armrest 20 on block 40.

In operation, armrest 20 may be moved and oriented in any direction within a plane of translation created by the pivotal motion about parallel axes A1, A2, and A3. The user may apply translation force in any direction, and members 14 and 16 will swivel and orient to accommodate the desired hand and forearm positions. This restrains armrest 20 to planar translation. However, armrest 20 may also be tilted angularly to pull longitudinal axis A4 out of parallel with or within the plane of translation by pivotal motion about axis A5. This permits a person with severe tremors to feed themselves by tilting about axis A5, without moving the center of forearm support 21 to a different elevation. Further, forearm support 21 may be pivoted about and brought closer to the person's mouth, and titled as required, for appropriate feeding. All movements are preferably damped adequately to prevent disruption due to unintentional tremors or movements.

While the preferred embodiment has been described for application with feeding, the present invention is not solely limited thereto, and the preferred apparatus or other apparatus designed in accord with the teachings of the present invention may be used to assist any individual to pursue many additional tasks. The present invention may be used for interaction with computers or many other diverse activities heretofore impossible to accomplish, and will also be useful for all persons involved with repetitive stress activities such as light assembly, clerical work, and meticulous hand control activities such as soldering or TIG welding, or any other similar activities.

While the foregoing details what is felt to be the preferred embodiment of the invention, no material limitations to the scope of the claimed invention are intended. Further, features and design alternatives that would be obvious to one of ordinary skill in the art are considered to be incorporated herein, including specific selections of materials, geometries and dimensions. The scope of the invention is set forth and particularly described in the claims herein below.

I claim:

1. An adaptive support arm for reducing the severity of tremors from disabilities and handicaps to impairments, comprising:

a base support;

a first support member pivotal about a first axis passing through said first support member and repositionable with respect to said base support along said first axis;

a first force-creating member securely engaging said base and engaging a first force responsive bushing between said base support and said first support member operative to variably set a steady resistance to said first axis pivotal motion while simultaneously permitting motion, to thereby dampen said tremors;

a second support member pivotal about a second axis displaced from said first axis and passing through said first support member;

a second force-creating member securely engaging said first support member and engaging a second force responsive bushing between said first support member and said second support member operative to variably set a steady resistance to said second axis pivotal motion while simultaneously permitting motion, to thereby dampen said tremors;

a longitudinally extensive armrest pivotal about a third axis displaced from said second axis and passing through said second support member;

a third force-creating member securely engaging said second support member and engaging a third force responsive bushing between said second support member and said longitudinally extensive armrest operative to variably set a steady resistance to said third axis pivotal motion while simultaneously permitting motion, to thereby dampen said tremors;

a pivotal member between said armrest and said second support member pivotal about a fourth axis angularly offset from said third axis having a fourth force-creating member securely engaging said pivotal member and engaging a fourth force responsive bushing operative to variably set a steady resistance to said fourth axis pivotal motion while simultaneously permitting motion, to thereby dampen said tremors; and an elbow pad extendible from said armrest and pivotal about a fifth axis angularly offset from said armrest longitudinal axis.

2. The adaptive support arm of claim 1 wherein said first, second and third force-creating members comprise a set screw, and said first, second and third force-responsive bushings comprise a brass tip terminating said set screw.

3. The adaptive support arm of claim 1 wherein said longitudinally extensive arm rest further comprises a forearm rest.

4. The adaptive support arm of claim 1 wherein said longitudinally extensive arm rest further comprises a palm rest.

5. The adaptive support arm of claim 1 wherein said fourth axis is perpendicular to said third axis.

6. The adaptive support arm of claim 5 wherein said first, second and third axes are parallel.

7. The adaptive support arm of claim 1 wherein said fifth axis is perpendicular to said armrest longitudinal axis.

8. The adaptive support arm of claim 1 further comprising a means for variably setting a resistance to said elbow pad pivotal motion about said fifth axis.

9. The adaptive support arm of claim 1 further comprising a pair of L-shaped rods spaced from each other and which are extendible parallel to said armrest longitudinal axis, said elbow pad independently pivotal about each of said L-shaped spaced rods, wherein longitudinal extension of a first one of said pair of L-shaped rods while a second one of said pair of L-shaped rods remains anchored effectuates pivotal motion of said elbow pad about said fifth axis.

10. An adaptive three-axis arm support, comprising:

an anchor member affixing to a support;

at least one arm restraint having a longitudinal axis and providing support for a user's arm against the pull of gravity and restraint of said user's arm;

a means for suspending and translating said arm restraint in any direction relative to said anchor member throughout and constrained within two axes which define a planar region of arm restraint positioning, and having a force-creating member engaging a force responsive bushing and operative thereby to variably set a steady resistance to said means for suspending and translating, to effectively dampen muscle tremors during said suspending and translating;

at least one means to provide height adjustment of said arm restraint to offset said planar region relative to said anchor member; and at least one means to pivot said arm restraint longitudinal axis into and out of said planar region.

11. The adaptive three-axis arm support of claim 10, wherein said means for suspending and translating said arm restraint further comprises:

a first support member pivotal about a first axis and having a brass-tipped set screw operatively engaging a pivotal member and thereby variably setting a resistance to said first axis pivotal motion, said first axis perpendicular to said planar region of arm restraint positioning and passing through said first support member; and a second support member pivotal about a second axis and having a brass-tipped set screw operatively engaging a pivotal member and thereby variably setting a resistance to said second axis pivotal motion, said second axis displaced from and parallel to said first axis and passing through said first and second support members.

12. The adaptive three-axis arm support of claim 11, wherein said at least one means to provide height adjustment of said arm restraint further comprises:

a rod defining said first axis; and a fastener retaining said first support member at a position with respect to said anchor member that is adjustable along said first axis when said fastener is released.

13. An adaptive feeding aid, comprising:

a base support;

a longitudinally extensive armrest;

an armrest support suspending and translating said armrest relative to said base support through and constrained within two axes which define a planar armrest translation region having a means for variably setting a resistance to said translating to adjust resistance to different needs of individual users;

an adjustable coupler between said base support and said armrest support adjusted to reposition said planar armrest translation region relative to said base support, said armrest support repositionable with respect to said base support along a first axis normal to said planar armrest translation region and held with respect thereto when supporting an arm;

a pivotal member between said armrest and said armrest support pivotal about an axis generally parallel to said planar armrest translation region and having a force-creating member securely engaging said pivotal member and engaging a force responsive bushing operative to variably set a steady a resistance to said pivotal motion which simultaneously permits said pivoting and varies said pivotal resistance, to permit resistance to be varied to different needs of individual users.

14. The adaptive feeding aid of claim 13 wherein said longitudinally extensive arm rest further comprises a forearm rest.

15. The adaptive feeding aid of claim 13 wherein said longitudinally extensive arm rest further comprises a palm rest.

16. The adaptive feeding aid of claim 13 further comprising an elbow pad extendible from said armrest and pivotal about an elbow pad pivot axis angularly offset from said armrest longitudinal axis.

17. The adaptive feeding aid of claim 13 further comprising a means for variably setting a resistance to said elbow pad pivotal motion.

18. The adaptive feeding aid of claim 13 further comprising a pair of L-shaped rods spaced from each other and which are extendible parallel to said armrest longitudinal axis, said elbow pad independently pivotal about each of said L-shaped spaced rods, wherein longitudinal extension of a first one of said pair of L-shaped rods while a second one of said pair of L-shaped rods effectuates pivotal motion of said elbow pad.

19. The adaptive feeding aid of claim 13 wherein said means for variably setting a resistance to said translating comprises at least one set screw with a force-responsive bushing adjacent to and engaging a rod normal to said planar armrest translation region.

* * * * *